US006702663B2

(12) United States Patent
Israel

(10) Patent No.: US 6,702,663 B2
(45) Date of Patent: Mar. 9, 2004

(54) ARRANGEMENT FOR PRODUCING AN AIR PARTITION

(76) Inventor: Christian Israel, Drosselweg 5, 09128 Chemnitz (DE)

( * ) Notice: Subject to any disclaimer, the term of this patent is extended or adjusted under 35 U.S.C. 154(b) by 0 days.

(21) Appl. No.: 10/338,508

(22) Filed: Jan. 8, 2003

(65) Prior Publication Data

US 2003/0129939 A1 Jul. 10, 2003

(30) Foreign Application Priority Data

Jan. 9, 2002 (DE) ..... 202 00 246

(51) Int. Cl.[7] ..... F24F 9/00
(52) U.S. Cl. ..... 454/190; 454/188
(58) Field of Search ..... 454/188, 190

(56) References Cited

U.S. PATENT DOCUMENTS 2,775,187 A 12/1956 McClurkin
3,350,994 A * 11/1967 Guibert ..... 454/190

FOREIGN PATENT DOCUMENTS

| | | |
|---|---|---|
| CH | 338 009 | 6/1959 |
| DE | 971 345 | 1/1959 |
| DE | 1 095 497 | 12/1960 |
| DE | 43 41 784 | 9/1995 |
| DE | 44 20 167 | 11/1995 |
| DE | 195 42 714 | 5/1997 |
| DE | 199 32 708 | 1/2001 |
| EP | 0 645 588 | 9/1994 |

OTHER PUBLICATIONS (1998), MAT–Frigoschleier, *Biddle*, pp. 1–5.

* cited by examiner

*Primary Examiner*—Jiping Lu
(74) *Attorney, Agent, or Firm*—Collard & Roe, P.C.

(57) ABSTRACT

An arrangement for producing an air partition on a passage between rooms with different air temperatures has a first ventilator whose air intake is arranged in a first room, and whose pressure side is located on a heating device having one heating element and a device for regulating the temperature. The temperature regulating device is connected to a sensor in a second room for detecting the partial pressure of the water vapor. The outlet of the heating device is connected with a pair of first air-blowing nozzles that are vertically arranged on each side of the passage in the first room and provided with a slot outlet extending over the entire height of the passage. In addition, a second ventilator with an air intake is located in the second room. A pair of second air-blowing nozzles is connected with the pressure side of this air intake. This second pair of blowing nozzles is vertically arranged on both sides of the passage and provided with slot outlets extending over the entire height of the passage.

11 Claims, 3 Drawing Sheets

ARRANGEMENT FOR PRODUCING AN AIR PARTITION

BACKGROUND (1) Field of the Invention

The invention relates to an arrangement for producing an air partition on a passage between rooms with different air temperatures. The invention may be applied to passages leading to objects for which the temperature of the air has to be maintained at a constant level, for example in warehouse facilities for storing perishable foods, chemicals, or other substances and materials requiring a constant temperature. The invention may also be applied to cooling chambers or refrigerating rooms.

(2) Prior Art

A variety of systems exist for producing air veils (or screens), air curtains or air partitions. These variations include those intended for screening off passages between rooms with greatly varying temperature levels. Partitioning passages leading to refrigerating rooms present a special problem. Relatively strong currents of compensation air are produced due to the great difference in the density of air having a warm or normal temperature level outside the refrigerating room, and the cold air prevailing within the refrigerating room. Also, the water vapor contained in the warmer air condenses on the interface between the different layers of air, producing an ice fog. The ice fog leads to icing phenomena in the passage. The icing occurs particularly in the area of impact of the air veils, as well as along the camber of the passage since the compensating flow and the load of moisture is the strongest in that area.

U.S. Pat. No. 2,775,187 describes an air flow barrier that prevents compensating air currents in an opening between two rooms at different temperature levels. The air flow barrier comprises a pair of air ducts of the same size that are arranged above the delimitation of the opening and within a cooling chamber. The air ducts are extended on flow chambers arranged on the jamb of the opening. These flow chambers have a curved front wall, a fixed plane back wall, a rib connecting the back wall and the front wall for separating the currents of air coming from the air ducts, and air-blowing nozzles located in the front wall. The nozzles are aligned in the longitudinal direction of the flow chambers and are set at a defined angle in relation to each other. The air ducts are connected with ventilators aspirating air from the respective room. A pair of air veils is produced in this way, flowing slightly away from each other and across the opening. The temperature of the air veils corresponds with the given temperature of the room air that is aspirated for producing the air veils. A drawback of this known solution is that the formation of ice fog is not prevented.

An air screen according to DE-PS 971 345 for room passages represents an advanced solution for preventing external air from flowing in through a passage due to difference between the temperature of the external air and the room air. This patent has air jets exiting from an air-blowing slot on one side of the passage and the room wall with an angle that is continuously changing or step by step over the clear height of the opening. The differences in the rate of inward flow prevailing on the opening in accordance with the height are taken into account in this manner.

The air "door" known from DE-PS 10 95 497 for dryers and industrial furnaces uses blowing slot areas whose angles can be adjusted, so that the blowing directions and ejection distances (or ranges) of the air jets respond to changing conditions by rotating individual or several nozzle sections against each other around their longitudinal axes.

However, neither of these references are intended or suited for screening off a passage leading to a refrigeration room. This problem is addressed by an air veil arrangement which, according to a company prospectus of the firm F. H. Biddle B. V. Kootstertille (Netherlands), is referred to as a "MAT-Frigoschleier", and known also from EP 06 45 588. According to these documents, the passage is swept by a veil of air that consists of at least three partial air currents flowing in the vertical direction for the purpose of separating the room air of a deep freezing chamber from external air. The partial air outer currents are formed by the respective room air; the one or more center currents of air are taken from the dry room air of the deep-freezing chamber and heated before they flow out. This prevents condensation of water vapor contained in the warm external air on the interface with the dry cold air.

Ice fog is produced in connection with this solution, and the formation of ice fog and icing cannot be avoided in the areas that are farthest removed from the blowing nozzles, and in the area of the floor. This is caused by induction effects leading to mixing between the partial air currents, and between the partial air currents and the room air adjacent to the latter, as well as to the eddying of the partial air currents in the area of impingement. This eddying may cause portions of the relatively moist partial flow of warm air, which is loaded with moisture, to penetrate the refrigeration room. However, the load of water vapor is condensed there, resulting in icing.

These effects are amplified by the difference between the density of the cold air of the refrigeration room and the warm external air, and by the tendency to pressure compensation based on the difference in the density. The horizontal arrangement of the blowing nozzles above the passage and the formation of at least three partial air currents require relatively high expenditure for generating the required flow volume and the required flow rate so as to safely sweep the entire passage and prevent compensation currents.

Preventing induction from occurring between the partial currents of air is known from DE 199 32 708 A1. The arrangement produces a veil of air in a passage leading to a low-temperature chamber by supplying an air-blowing nozzle both inside and outside of the low-temperature chamber that is supplied with dry and heated air exclusively aspirated from the low-temperature chamber. The blowing directions are adjusted so that a crossing of the air currents takes place. In particular, the center blowing direction of the blowing nozzle arranged in the low-temperature chamber intersects the plane of the door. However, icing can be avoided only if the partitioning of the low-temperature chamber against compensation currents is cut back.

A combination of the known solutions fails to lead to a satisfying result. Accordingly, in spite of a multi-faceted search over many years, it has not been possible to resolve the screening off of rooms with air at different temperature levels because of the problem posed by ice fog formation and icing phenomena.

SUMMARY

The present invention provides for the separation of air in a passage between rooms with different air temperatures while avoiding icing phenomena in conjunction with a significant reduction of compensation currents as well as expenditures.

The air intake (or suction) part of a first ventilator is arranged in a cooler room. The pressure side of this first ventilator is connected to a heating device that has at least one heating element and a device for controlling the loading temperature. The device is connected to a sensor arranged in a warmer room for detecting the partial pressure of the water vapor. The output of the heating device is connected to at least one first blowing nozzle, which is arranged in the cooler room vertically next to the passage. It is provided with a slot outlet extending over the entire height of the passage. A pair of first blowing nozzles are arranged in the cooler room on each of the two sides of the passage. These air-blowing nozzles are connected with the outlet of the heating device.

A second ventilator with an air intake part is located in the warmer room. A pair of second air-blowing nozzles is connected to the pressure side of this air intake part. These second air nozzles are arranged in the warmer room vertically on both sides of the passage, and provided with slot outlets extending over the entire height of the passage.

The slot outlets of the first and second air nozzles are divided in two sections that are displaced (or offset) in relation to one another. In the lower area the first blowing nozzles are set so that they are pointing away from the plane of the passage and offset by between 25° and 45°. In the upper area the first blowing nozzles are adjusted so that they point in the direction of the plane of the passage, offset by between 15° and 35°. The direction in which the second air-blowing nozzles are blowing out air, on the other hand, are set in the lower area offset by between 5° and 30°, pointing in the direction of the plane of the passage, and in the upper area offset by between 25° and 45°, pointing away from the plane of the passage.

The size of the cross sectional areas of the first and the second air-blowing nozzles, and the width of the gaps of the slot outlets of the first and the second air-blowing nozzles are coordinated depending on the width of the passage and the temperature difference between the cooler room and the warmer room.

The heating element is operated above a 2 mbar limit value of the water vapor partial pressure of the air of the warmer room depending on the water vapor partial pressure of the air of the warmer room, width of the passage opening, and the temperature difference between the air in the cooler room and the air in the warmer room. Both the warmer and the cooler areas may be located in the same building. Likewise it is possible that either the cooler or the warmer area is located in a building, and the other area externally adjacent to the building.

The invention produces a partial current of air that is dry to the highest possible degree. It has a temperature that is controlled by the water vapor partial pressure of the air in the warmer space, which raises the capacity of the dry partial current of air to absorb moisture and thus prevent saturation that leads to the formation of ice fog on the interfaces of the partial currents of air producing the partition. Any icing is prevented in this manner within the area of the passage. The partial currents of air can be produced in an effective manner in terms of energy. Due to the development of a vertically resulting line of back-up in the center of the passage from the flat and directed jets of air acting over the entire height of the passage, both the discharge of cold air flowing from the cooler space, and the current of warm air flowing into the cooler space, accepting cutbacks within the partition is completely prevented.

The jet pulse of the first air-blowing nozzles may be twice as high as the jet pulse of the second air-blowing nozzles. Depending on the temperature difference and thus the difference in the density between the air of the cooler space and the air in the warmer space, the slot outlets are optimally divided in upper and lower areas. The divisions start from a center division based on the total length of the slot outlets. They permit the development of the optimal back-up line depending on the typical compensation tendencies of the air flow. The same purpose is served by the way the plate impinged upon is arranged above the second air-blowing nozzles, in that induction between the exiting partial flow of warm air and the air present above the second air-blowing nozzles is prevented from occurring within the proximity of the passage. This is also achieved by the formation of a gate, which is an extension of the jamb of the passage into the warmer space. Uncontrolled currents are excluded by arranging the first air-blowing nozzles on the wall of the cooler room or space with no gaps in between, to the greatest extent this is possible.

The development of an optimal line of back-up is made possible even under variable conditions by rotating the air-blowing nozzles and/or by turning the sections of the air-blowing nozzles. This rotation may take place manually or in an automated manner, whereby in addition to the temperature difference between the air of the cooler space and the air of the warmer space, it is possible to detect and factor in the wind load if the passage leading into the external area is involved.

The gap widths of the second air-blowing nozzles are dimensional so that the gap widths of the lower slot outlet areas amount to from 60% to 80% of the gap widths of the upper slot outlet areas. Any superimposition of the lower streams of air being blown out by the first and second air-blowing nozzles is avoided. Any penetration of warm air into the cooler room by the lower stream of air blown out by the second air-blowing nozzles that may occur, is thus prevented. By arranging the air intake part of the first ventilator remotely from the passage, it is assured that the current of partitioning air in the cooler room or space is loaded with moisture only to the lowest possible extent. The design of the heating element in the form of a heat-storing heater system reduces the energy requirements and enhances the control property of the heating device so that thermal energy can be continually "called in" for heating the air aspirated from the cooler room.

The application of the invention is not limited to partitioning off rooms (or spaces) with different air temperature levels. By modifying the components of the arrangement and/or the overall arrangement as defined by the invention, with respect to its components, it is possible to realize both general and otherwise application-specific air partitioning or air veil solutions in accordance with the invention. This applies to, for example, air partitioning arrangements for operating systems, manufacturing plants and other industrial and service areas, as well as to luggage conveyor systems installed, for example at airports or railway stations.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
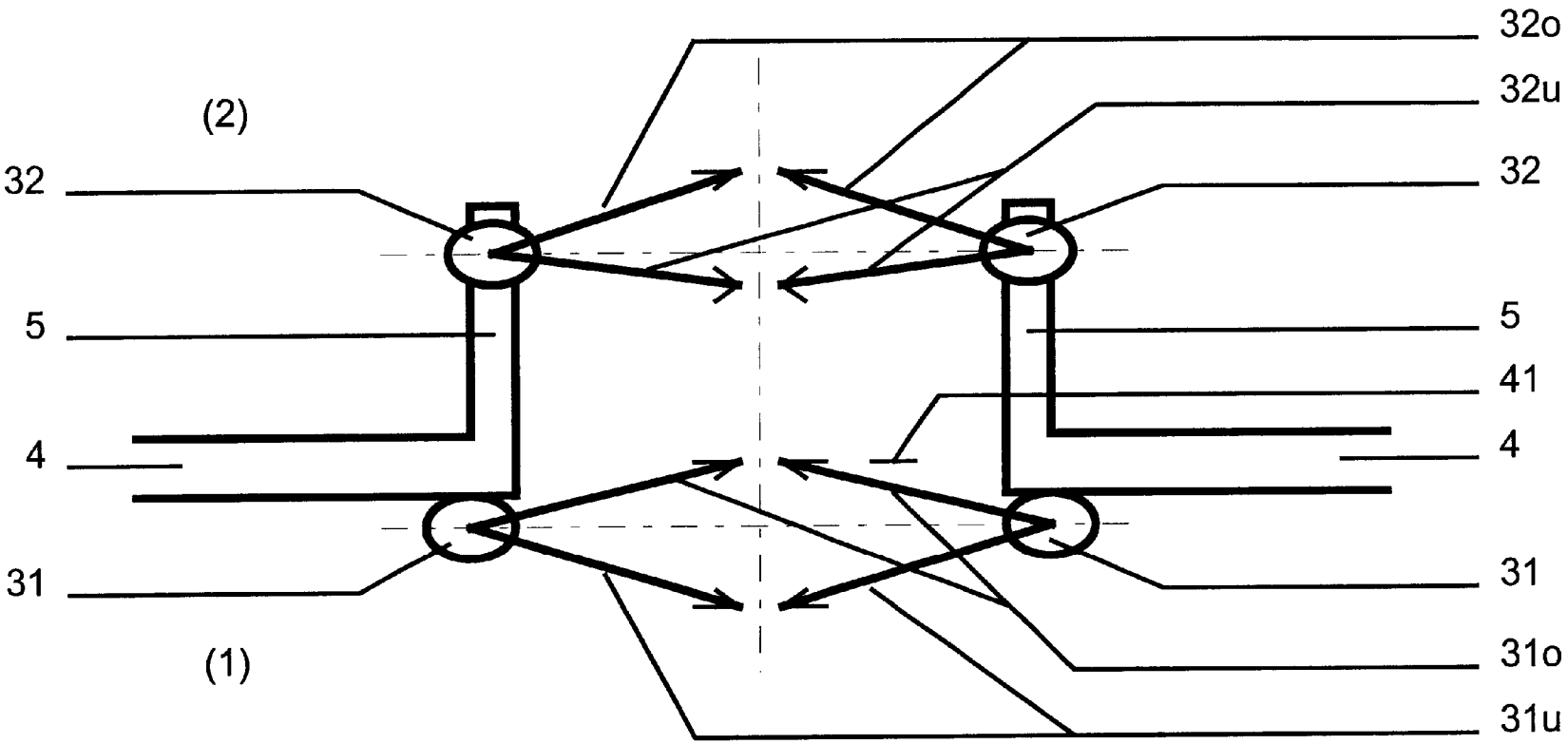
FIG. 1 shows a schematic cross section through an arrangement as defined by the invention, with an extended jamb of the passage.

Referring in detail to the drawings, FIG. 1 shows first partitioning air blowing nozzles 31 arranged vertically on both sides of a passage 41 in a wall 4 between a refrigerating room 1 and a room 2 with a normal room temperature without any gap from wall 4. The jamb of passage 41 protrudes into room 2 in the form of extensions 5 in the manner of a gate. Second air-blowing nozzles 32 are vertically integrated in extensions 5, removed from wall 4.

The slot outlets (see FIGS. 2 and 3) of partitioning air-blowing nozzles 31, 32 are divided crosswise around the center area, so that lower and upper areas are formed which blow air out through the nozzles in different directions. A lower blowing direction 31*u* of first partitioning air-blowing nozzles 31 is set at an angle of about 30°, pointing away from the plane of passage 41. An upper blowing direction 31*o* of first partitioning air-blowing nozzles 31, however, is set at an angle of about 20°, pointing at the plane of passage 41. Lower blowing direction 32*u* of second air-blowing nozzles 32 is set at an angle of about 10°, pointing in the direction of the plane of passage 41. Upper blowing direction 32*o* of second air-blowing nozzles 32, however, is set at an angle of about 40°, pointing away from the plane of passage 41.

Figure 2A:
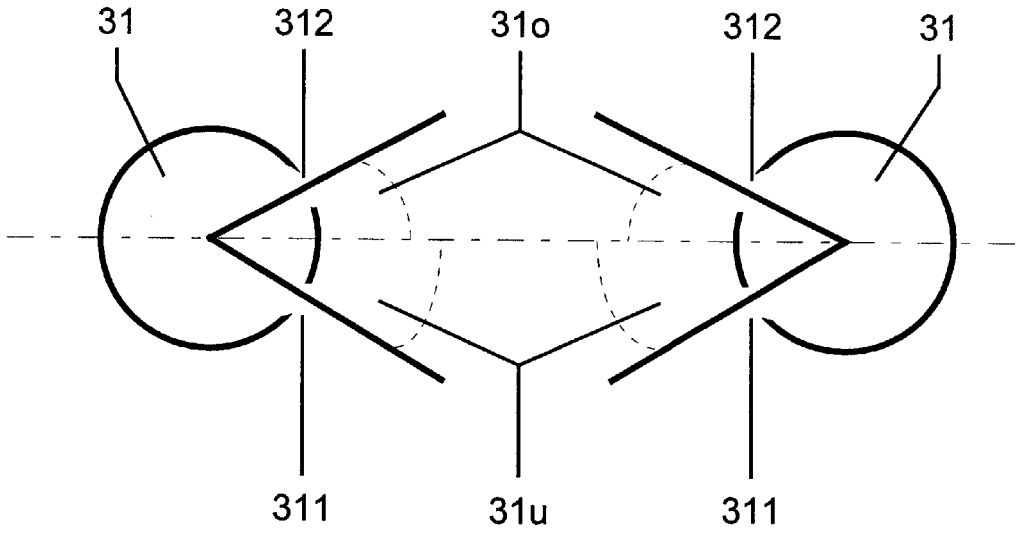
FIG. 2A is a schematic representation of the directions in which the first air-blowing nozzles according to FIG. 1 are blowing.

FIG. 2A shows first partitioning blow nozzles 31 with lower slot air outlets 311 and upper slot air outlets 312, which are arranged at offset angles in relation to one another. Center lower blowing direction 31*u* is set at about an angle of 30° with respect to the plane of the axis of first partitioning blow nozzles 31, and upper center blowing direction 31*o* is set at an angle of about 20° with respect to the plane of the axis via upper slot air outlets 312. The result is an overall angle of about 50° between the center blowing directions of first partitioning blow nozzles 31.

Figure 2B:
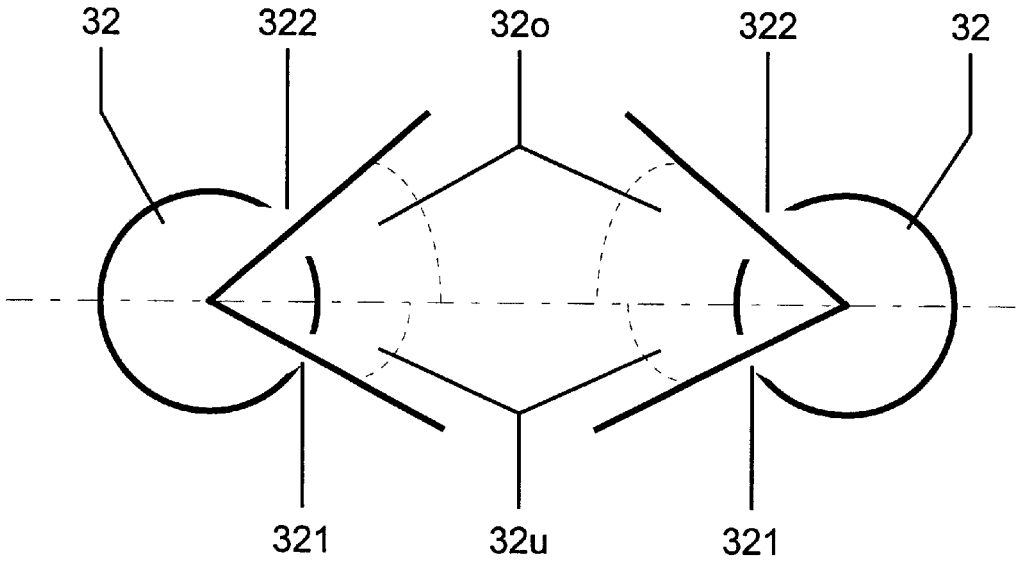
FIG. 2B is a schematic representation of the directions in which the second air-blowing nozzles according to FIG. 1 are blowing.

FIG. 2B shows second partitioning blow nozzles 32 with lower slot air outlets 321 and upper slot air outlets 322, which are set at offset angles in relation to each other. A lower center blowing direction 32*u* is set at an angle of about 10° with respect to the plane of the axis of second partitioning blow nozzles 32 via lower slot air outlets 321. An the upper center blow direction 32*o* is set at an angle of about 40° the axis of the plane via upper slot air outlets 322. The result is an overall angle of about 50° between the center blowing directions of second partitioning blow nozzles 32.

Figure 3:
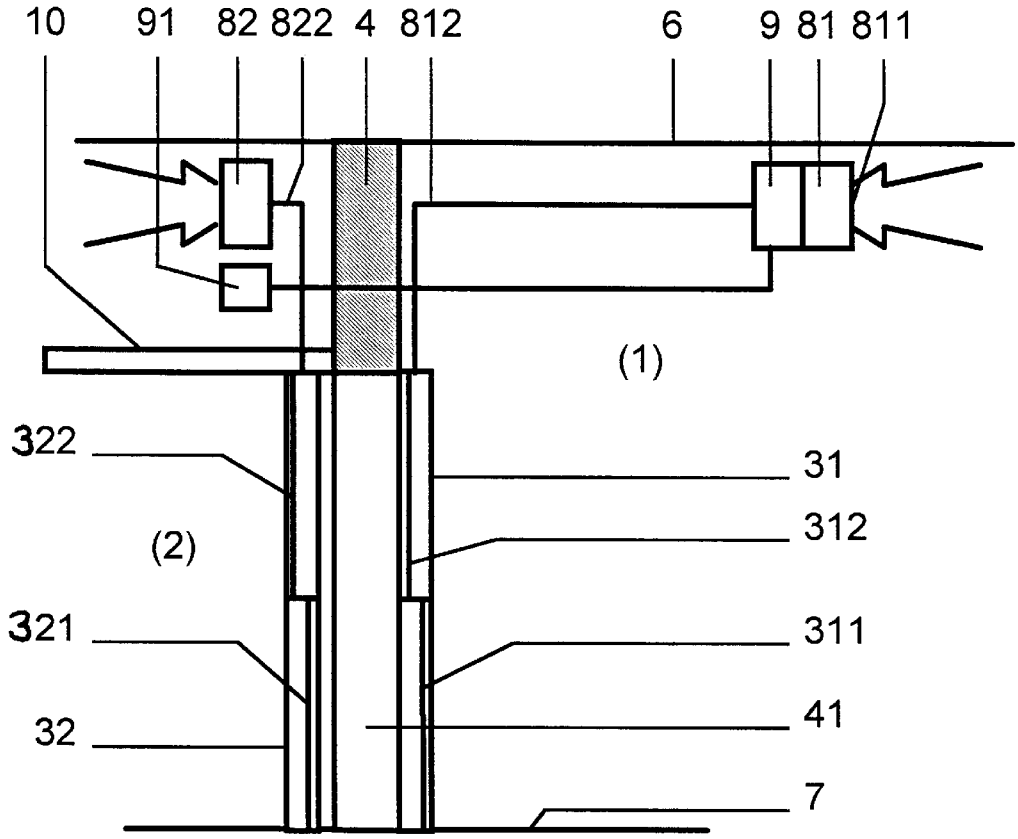
FIG. 3 shows a schematic longitudinal cross section through an arrangement as defined by the invention without an extended jamb of the passage.

FIG. 3 shows a schematic longitudinal section through an arrangement as defined by the invention. Wall 4 with passage 41 is located between a floor 7 and a ceiling 6 of refrigerating room 1 and room 2 with a normal air temperature. On the side of refrigerating room 1, first partitioning air-blowing nozzles 31 are arranged vertically and without any gap between these nozzles and wall 4.

These first partitioning air-blowing nozzles are connected with the outlet of a heating device 9 via a flow line 812, which is advantageously designed in the form of a wound, grooved pipeline. Heating device 9 is comprised of a storage heating element and a loading-temperature control device. The control device is connected with a water-vapor partial pressure sensor 91 that is suitably arranged in room 2. On the pressure side, heating device 9 is connected to a first ventilator 81. An air intake 811 of first ventilator 81 is remotely installed from passage 41.

First partitioning, air-blowing nozzles 31 comprise slot outlets divided into lower area 311 and upper area 312. These two areas are set at different blowing angles with respect to the plane of passage 41, as shown in FIGS. 1 and 2A. Second partitioning, air-blowing nozzles 32 are vertically arranged on the side of passage 41 facing room 2. Nozzles 32 are connected with the pressure side of a second ventilator 82 via a flow line 822 preferably designed in the form of a wound, grooved pipeline. Second partitioning, air-blowing nozzles 32 also comprise slot outlets that are divided into lower area 321 and upper area 322. These two areas are set at different blowing angles with respect to the plane of passage 41, as shown in FIGS. 1 and 2B.

A plate 10 impinged upon by the flow of air is arranged horizontally above the second partitioning, air-blowing nozzles 32, resting on the latter, as well as flush on wall 4. The cantilevering amounts to at least half of the width of the passage 41. Over the width, plate 10 impinged by the flow of air completely covers partitioning, air-blowing nozzles 32.

Accordingly, while at least one embodiment of the present invention has been shown and described, it is to be understood that many changes and modifications may be made thereunto without departing from the spirit and scope of the invention as defined in the appended claims.

What is claimed is:

1. An arrangement for producing an air partition in a passage between a first colder room and a second warmer room comprising:

at least one first ventilator having an intake side and a pressure side, wherein said intake side is disposed in the first colder room;

a heating device coupled to said pressure side of said at least one first ventilator and having an output, wherein said heating device comprises at least one heating element and a device for regulating a heating temperature;

a sensor disposed in the second warmer room for detecting water vapor partial pressure, wherein said sensor is connected to said device for regulating a heating temperature;

a pair of first air blowing nozzles connected with said output of said heating device and disposed vertically on each side of the passage, extending over an entire height of said passage and facing the first colder room;

a second ventilator having an intake side and a pressure side, wherein said intake side is disposed in the second warmer room;

a pair of second air blowing nozzles connected with said pressure side of said second ventilator and disposed vertically on each side of the passage, extending over the entire height of the passage; and slot outlets on said pair of first air blowing nozzles and said pair of second air blowing nozzles and extending over the entire height of the passage, wherein said slot outlets are divided into a lower area and an upper area offset in relation to each other on each air blowing nozzle;

wherein blowing directions of said pair of first air blowing nozzles in said lower area are directed at angles between 25° and 45° away from a plane of said passage and in said upper area directed at angles between 15° and 35° toward said plane of said passage;

wherein blowing directions of said pair of second air blowing nozzles in said lower area are at angles between 5° and 30° toward said plane of said passage and in said upper area at angles between 25° and 45° away from said plane of said passage;

wherein a size of cross sectional areas of said pair of first air blowing nozzles and said pair of second air blowing nozzles, as well as gap widths of said slot outlets, are dependent on a width of the passage and a temperature difference between the first colder room and the second warmer room; and wherein said heating element supplies heat depending on water vapor partial pressure of the air of the second room above a limit value of 2 mbar, and depending on said width of the passage and said temperature difference between the air in the first colder room and the air in the second warmer room.

2. The arrangement according to claim 1, wherein a jet pulse of said pair of first air-blowing nozzles is twice as high as a jet pulse of the second air-blowing nozzles.

3. The arrangement according to claim 1, wherein said slot outlets are divided in a center third part of their overall length.

4. The arrangement according to claim 1, further comprising a horizontal plate impinged upon by the flow of air, disposed above said pair of second air-blowing nozzles, wherein said plate adjoins a wall above the passage, covering at least an outer spacing of said pair of second air-blowing nozzles, having an expanse in the second room of at least half of said width of the passage, starting from a plane of said pair of second air-blowing nozzles, and resting on said pair of second air-blowing nozzles with substantially no gap.

5. The arrangement according to claim 1, wherein said pair of first air-blowing nozzles are disposed with substantially no gap from the wall.

6. The arrangement according to claim 1, wherein a jamb of the passage extends on both sides so that it projects into the second room in the manner of a gate.

7. The arrangement according to claim 1, wherein said pair of first air-blowing nozzles and said pair of second air-blowing nozzles can be rotated around their longitudinal axes.

8. The arrangement according to claim 1, wherein nozzle bodies of said pair of first air-blowing nozzles and said pair of second air-blowing nozzles are divided in accordance with the division of the slot outlets, and so that they can be rotated in sections around their longitudinal axes.

9. The arrangement according to claim 1, wherein said slot outlets in said lower areas of said pair of second blowing nozzles have gap widths that range from 60% to 80% of a width of a gap of said upper areas of said slot outlets of said pair of second blowing nozzles.

10. The arrangement according to claim 1, wherein said intake of said first ventilator is remotely arranged from the passage.

11. The arrangement according to claim 1, wherein said heating element comprises a heat-storing device.

* * * * *